US005825282A

United States Patent [19]

Aronne

[11] Patent Number: 5,825,282

[45] Date of Patent: Oct. 20, 1998

[54] TESTING DEVICE FOR AND METHOD OF TESTING A SQUIB OF AN ELECTRO BALLISTIC SYSTEM

[75] Inventor: Armand J. Aronne, Massapequa, N.Y.

[73] Assignee: Northrop Grumman Corporation, Los Angeles, Calif.

[21] Appl. No.: 554,114

[22] Filed: Nov. 6, 1995

Related U.S. Application Data

[63] Continuation-in-part of Ser. No. 226,718, Apr. 12, 1994, abandoned.

[51] Int. Cl.[6] ..... B60Q 1/00

[52] U.S. Cl. ..... 340/438; 280/734; 280/735; 340/436

[58] Field of Search ..... 340/436, 438; 280/734, 735; 307/10.1; 73/35.07; 180/282; 102/530, 202, 202.3, 202.9

[56] References Cited

U.S. PATENT DOCUMENTS

| | | | |
|---|---|---|---|
| 4,990,889 | 2/1991 | Lebsock | 340/515 |
| 5,122,780 | 6/1992 | Midorikawa et al. | 340/438 |
| 5,158,323 | 10/1992 | Yamamoto et al. | 340/438 |
| 5,406,127 | 4/1995 | Furui et al. | 340/438 |
| 5,459,449 | 10/1995 | Ravas, Jr. et al. | 340/438 |

*Primary Examiner*—Brent A. Swarthout
*Attorney, Agent, or Firm*—Terry J. Anderson; Karl J. Hoch, Jr.

[57] ABSTRACT

A testing device for testing the continuity of a firing circuit for a squib of an electro-ballistic system which includes a propellant and a plurality of spaced pin-like detonator wires embedded in the propellant. Each of the detonator wires has a first end positioned outside the propellant and a spaced opposite second end embedded in the propellant. Low resistance bridge detonating wires are embedded in the propellant, and electrically connect the second ends of selected ones of the detonator wires. The testing device is embedded in the propellant in spaced relation with the detonator wires and tests the continuity of the firing circuit for the squib. The testing device includes a pair of spaced pin-like test wires embedded in the propellant, with each test wire having a first end outside the propellant and a spaced opposite second end embedded in the propellant. A low-resistance bridge test wire is embedded in the propellant and electrically connects the second ends of the test wires. The continuity of the firing circuit for the squib is tested by passing a low magnitude electrical current through the test wires, the magnitude of which is low compared with the current passed through the detonating wires during ignition of the squib.

6 Claims, 1 Drawing Sheet

TESTING DEVICE FOR AND METHOD OF TESTING A SQUIB OF AN ELECTRO BALLISTIC SYSTEM

This patent application is a continuation-in-part patent application of parent patent application Ser. No. 08/226,718, filed Apr. 12, 1994, now abandoned.

BACKGROUND OF THE INVENTION

1. Field of the Invention

The present invention relates generally to a testing device for a squib and a method of testing a squib. More particularly, the subject invention relates to a testing device for a squib of an electro-ballistic system and a method of testing such a squib.

2. Discussion of the Prior Art

Electro-ballistics in ejection seat sequencing systems have many good features, and are gaining rapid ascendancy in the art. Newer ejection seats have led the way, and it is now necessary to provide a built-in-test (BIT) feature to check out such systems. Continuity tests are capable of verifying if the squib ignition system of the electro-ballistic system is fully connected and if all plugs and connectors are correctly inserted and connected.

The most difficult component to check is the end squib (type of arrangement that burns with a hissing, spurting noise before exploding). The end squib is usually a four-pin device with four wires running to two bridge wires embedded in the propellant of the squib. During ignition, when a high current flows through the wires, the bridge wires heat sufficiently to fire the squib. During testing, when a low current is transmitted through the bridge wires to verify continuity, without firing the squib, the propellant around the bridge wires may become glazed after continuous testing. This can greatly decrease the reliability of the squib and the electro-ballistic system and the testing thereof.

SUMMARY OF THE INVENTION

Accordingly, it is a primary object of the present invention to provide a testing device and a method of testing a squib in any type of electro-ballistic system, including but not limited to electro-ballistics in injection seat systems, with efficiency, effectiveness and reliability.

A further object of the subject invention is the provision of a testing device and a method of testing a squib of an electro-ballistic system without decreasing the reliability of the squib or the electro-ballistic system or testing in any manner.

Still another object of the invention is provide a testing device and a method of testing a squib of an electro-ballistic system, which device and method are inexpensive to implement and have no adverse effects on the system.

In accordance with the teachings herein, the present invention provides an electro-ballistic squib system comprising a propellant and a plurality of spaced detonator wires embedded in the propellant for detonation thereof. Each of the detonator wires has a first end positioned outside the propellant and a spaced opposite second end embedded in the propellant. A low resistance bridge detonating wire is embedded in the propellant for detonation thereof, and is connected across a pair of second ends of the detonator wires. A testing device is positioned in spaced relation to the detonator wires, and comprises a pair of spaced test wires, with each of the test wires having a first end outside the propellant and a spaced opposite second end embedded in the propellant. A low-resistance bridge test wire is embedded in the propellant and electrically connected across the second ends of the test wires. A low electrical test current is applied to the testing device to determine if the electro-ballistic system is properly connected, which avoids applying the test current to the detonating wire and possible glazing of the propellant therearound.

In greater detail, in one embodiment the plurality of spaced detonator wires consists of four wires, a first and second of which are connected by a low-resistance bridge detonating wire and a third and fourth of which are connected by a low-resistance bridge detonating wire. In a second embodiment, the plurality of spaced detonator wires consists of four wires, all of which are connected by one low-resistance bridge detonating wire.

Moreover, the lengths of the test wires projecting about the surface of the propellant are longer than the lengths of the detonator wires projecting about the surface of the propellant, such that successful electrical connections to the shorter test wires during a continuity test virtually ensures that successful electrical connections are being made to the longer detonator wires.

The present invention also provides a method of testing a squib of an electro-ballistic system having a propellant, and a plurality of spaced detonator wires embedded in the propellant, with each of the detonator wires having a first end positioned outside the propellant and a spaced opposite second end embedded in the propellant. Low resistance bridge detonating wires are embedded in the propellant and electrically connect the second ends of the detonator wires. Pursuant to the method, a pair of test wires is embedded in the propellant in spaced relation to the detonator wires, with a first end of each test wire being positioned outside the propellant and a second end of each test wire being embedded in the propellant. A low-resistance bridge test wire is electrically connected across the second ends of the test wires, with the bridge test wire being embedded in the propellant. A low magnitude test electrical current is transmitted through the test wires, the presence of which verifies the continuity of the firing circuit of the electro-ballistic system.

BRIEF DESCRIPTION OF THE DRAWINGS

The foregoing objects and advantages of the present invention for a testing device and a method of testing a squib of an electro-ballistic system may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 1:
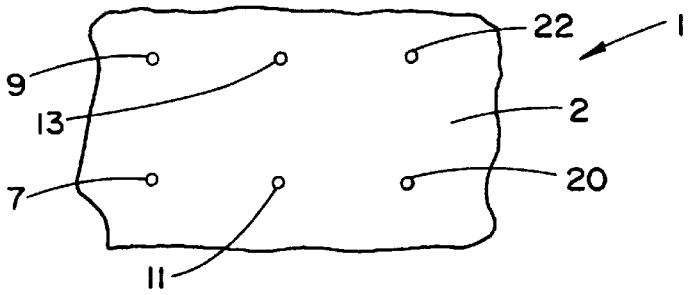
FIG. 1 is a top view of part of a squib of an electro-ballistic ejection seat sequencing system with an embodiment of the testing device of the present invention installed therein.
Figure 2:
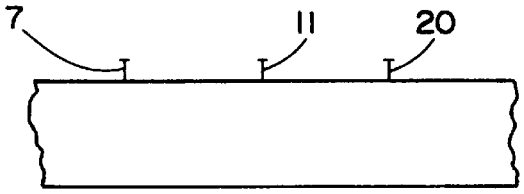
FIG. 2 is a side view of the system shown in FIG. 1.

Referring to the drawings in detail, the squib 1 of an electro-ballistic ejection seat sequencing system includes a propellant 2, FIGS. 1 and 2, as is well known in the art. The squib 1 also include a plurality of spaced pin-like detonator wires, 3, 4, 5, and 6, FIGS. 3 and 4, embedded in the propellant 2, as is well known in the art. Each of the pin-like detonator wires 3, 4, 5 and 6 has a first end outside the propellant 2 and a spaced opposite end embedded in the propellant. Thus, as illustrated in FIGS. 3 and 4, wire 3 has a first end 7 and a second end 8, wire 4 has a first end 9 an a second end 10, wire 5 has a first end 11 and a second end 12, wire 6 has a first end 13 and a second end 14.

The squib 1 further includes low resistance bridge detonating wires embedded in the propellant 2 and electrically connecting the second ends 8, 10, 12, and 14 of selected ones of the wires 3, 4, 5 and 6, respectively, to each other.

Figure 3:
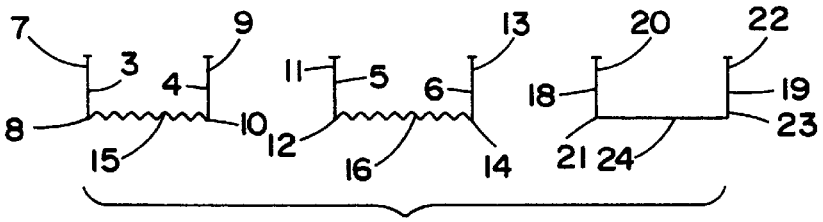
FIG. 3 is a circuit diagram of the embodiment of FIGS. 1 and 2 with a first bridging circuit of the squib wires.

In the embodiment of FIG. 3, the first and second wires 3 and 4, respectively, are connected at their second ends 8 and 10, respectively, by a bridge detonating wire 15. Similarly, the third and fourth wires 5 and 6, respectively, are connected at their second ends 12 and 14, respectively, by a bridge detonating wire 16.

Figure 4:
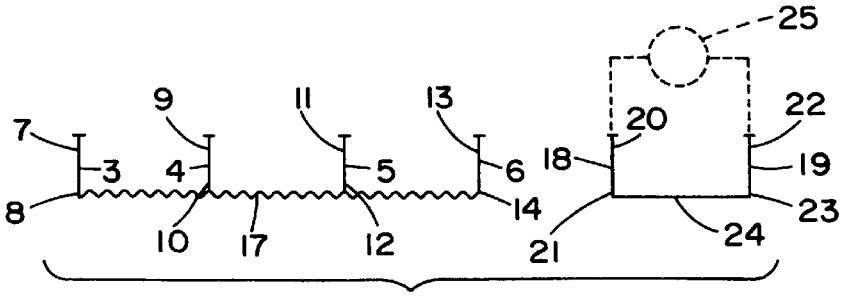
FIG. 4 is a circuit diagram of the embodiment of FIGS. 1 and 2 with a second bridging circuit of the squib wires.

In the embodiment of FIG. 4, all of the wires 3, 4, 5 and 6 of the squib 1 are connected by a single low resistance bridge detonating wire 17.

The squib testing device of the present invention is embedded in the propellant 2 in spaced relation to the wires 3, 4, 5 and 6, as shown in FIGS. 1 to 4. The testing device determines if the electro-ballistic system squib is fully and properly connected and all plugs and connectors are correctly inserted, without causing any glazing damage to the squib. The testing device has a pair of spaced pin-like test wires 18 and 19 embedded in the propellant 2, FIGS. 3 and 4. The test wire 18 has a first end 20 outside the propellant 2 and a spaced opposite second end 21 embedded in the propellant, and similarly the test wire 19 has a first end 22 outside the propellant 2 and a spaced opposite second end 23 embedded in the propellant.

A low-resistance bridge test wire 24 is embedded in the propellant 2, and electrically connects the second ends 21 and 23 of the wires 18 and 19, FIGS. 3 and 4. During a continuity test, a power source 25, shown in phantom in FIG. 4, is connected to the test wires 18 and 19, rather than to the pairs of detonator wires 3 and 4 and also 5 and 6. A low electrical current is transmitted through the bridging wire 24 with the aid of the power source 25 to verify the continuity of the firing circuit. After a test, the propellant around the low resistance bridge detonating wires 15 and 16 has not been adversely affected (glazed) by the continuity test.

The detonator pins 3, 4, 5, and 6 have a standard length, and are normally connected by a corresponding four conductor female electrical coupler to the squib ignition circuit. The present invention adds two additional test pins 18 and 19, and the lengths of the test pins 18 and 19 projecting above the surface of the propellant are slightly shorter than the lengths of the detonator pins 3, 4, 5, and 6 projecting above the surface of the propellant. In the embodiments of FIGS. 3 and 4, the pins 3, 4, 5, 6, 18 and 19 are connected by a corresponding six conductor female electrical coupler to the squib ignition circuit and the continuity test circuit. Corresponding male and female electrical couplers are normally screwed together to form a complete electrical coupler, and the shorter lengths of the test pins 18 and 19 ensures that the male and female electrical couplers are correctly and fully connected, such that if the circuit passes the continuity test, the longer detonator pins 3, 4, 5 and 6 will surely be correctly electrically connected in the squib ignition circuit.

In the method of the present invention for testing a squib of an electro-ballistic system, a low electrical current is transmitted through the propellant 2 in spaced relation with the detonator wires 3, 4, 5 and 6. The method is undertaken by embedding a pair of pin-like wires 18 and 19 in the propellant 2 in spaced relation with the detonator wires, with the first end 20 and 22, respectively of each of the wires positioned outside the propellant and the second end 21 and 23, respectively, of each of the wires embedded in the propellant. A low-resistance bridge wire 24 is electrically connected to the second ends 21 and 23 of the test wires 18 and 19, and is also embedded in the propellant 2. This effectively short-circuits the second ends 21 and 23 of the test wires 18 and 19 in the propellant 2.

In summary, the present invention starts with a squib as illustrated, for example, in FIG. 3, left and middle portions, and adds thereto the structure illustrated on the right portion of FIG. 3, in which the squib testing device comprises pin wires 18 and 19 (spaced from pin wires 3, 4, 5 and 6) embedded in the propellant 2, effectively short circuited by a low resistance bridge test wire 24. A low electrical current is applied through the bridge wire 24, which is present only for testing and not for firing of the squib, with the aid of a power source 25 to test the continuity of the firing circuit. Accordingly, the squib testing device tests the continuity of the firing circuit to the squib. The squib testing device does not encompass direct testing of the bridge wires 15 and 16.

However, the continuity test is capable of verifying if the system is fully connected and that all plugs and connectors are correctly inserted and connected. Accordingly, although the present invention does not directly test the bridge wires 15 and 16, a continuity test is performed to verify that the system and all plugs and connectors are properly connected.

While several embodiments and variations of the present invention for a testing device and a method of testing a squib of an electro-ballistic system are described in detail herein, it should be apparent that the disclosure and teachings of the present invention will suggest many alternative designs to those skilled in the art.

What is claimed is:

1. An electro-ballistic squib system comprising:

a. a propellant and a plurality of spaced detonator wires embedded in the propellant for detonating the propellant, each of the detonator wires having a first end positioned outside the propellant and a spaced opposite second end embedded in the propellant, and a low resistance bridge detonating wire embedded in the propellant for detonating the propellant and being connected across a pair of second ends of the detonator wires;

b. a testing device positioned in spaced relation to the detonator wires, comprising a pair of spaced test wires, each of the test wires having a first end outside the propellant and a spaced opposite second end embedded in the propellant, and a low-resistance bridge test wire embedded in the propellant and electrically connecting the second ends of the test wires;

c. means for applying a low electrical test current to the testing device through test conductors of an electrical conductor device which also includes connections to the detonator wires, to determine if the electro-ballistic system is properly connected, which avoids applying the test current to the detonating wire and possibly glazing the propellant therearound.

2. The system as claimed in claim 1, wherein said plurality of spaced detonator wires consists of four wires, a first and second of which are connected by a low-resistance bridge detonating wire and a third and fourth of which are connected by a low-resistance bridge detonating wire.

3. The system as claimed in claim 1, wherein said plurality of spaced detonator wires consists of four wires, all connected by one low-resistance bridge detonating wire.

4. The system as claimed in claim 1, wherein the lengths of the test wires projecting above the surface of the propellant are shorter than the lengths of the detonator wires projecting above the surface of the propellant, such that successful connections to the shorter test wires during a continuity test virtually ensures successful connections to the longer detonator wires.

5. A method of testing a squib of an electro-ballistic system having a propellant, a plurality of spaced detonator wires embedded in the propellant, each of the detonator wires having a first end positioned outside the propellant and a spaced opposite second end embedded in the propellant, and low resistance bridge detonating wires embedded in the propellant and electrically connecting the second ends of the detonator wires, comprising the steps of:

a. embedding a pair of test wires in the propellant in spaced relation to the detonator wires, with a first end of each test wire being positioned outside the propellant and a second end of each test wire being embedded in the propellant;

b. electrically connecting a low-resistance bridge test wire across the second ends of the test wires with the bridge test wire being embedded in the propellant; and c. transmitting a low magnitude test electrical current through the test wires via test conductors of an electrical conductor device which also includes connections to the detonator wires, the presence of which verifies the continuity of the firing circuit of the electro-ballistic system.

6. A method of testing a squib as claimed in claim 5, wherein the lengths of the test wires projecting above the surface of the propellant are shorter than the lengths of the detonator wires projecting above the surface of the propellant, such that successful connections to the shorter test wires during a continuity test virtually ensures successful connections to the longer detonator wires.

* * * * *